US006283387B1

(12) United States Patent
Palestrant

(10) Patent No.: US 6,283,387 B1
(45) Date of Patent: Sep. 4, 2001

(54) MISTING HEAD POPPET

(76) Inventor: Nathan Palestrant, 5120 N. 79th Pl., Scottsdale, AZ (US) 85250

( * ) Notice: Subject to any disclaimer, the term of this patent is extended or adjusted under 35 U.S.C. 154(b) by 0 days.

(21) Appl. No.: 09/283,731

(22) Filed: Apr. 1, 1999

Related U.S. Application Data

(63) Continuation-in-part of application No. 29/095,590, filed on Oct. 27, 1998, now Pat. No. Des. 412,557.

(51) Int. Cl.[7] ..... B05B 1/34

(52) U.S. Cl. ..... 239/464; 239/463; 239/487; 239/488

(58) Field of Search ..... 239/589, 590, 239/590.5, 487, 488, 461, 463, 464, 533.1

(56) References Cited

U.S. PATENT DOCUMENTS

| | | | | |
|---|---|---|---|---|
| 2,180,523 | * | 11/1939 | Horton | 239/488 |
| 2,609,238 | * | 9/1952 | Anderson | 239/488 X |
| 3,062,455 | * | 11/1962 | Reip . | |
| 3,249,305 | | 5/1966 | Baker . | |
| 3,504,893 | * | 4/1970 | Susuki et al. | 239/488 |
| 4,702,034 | | 10/1987 | Ferguson et al. | 47/33 |
| 4,721,250 | | 1/1988 | Kennedy et al. | 239/383 |
| 5,154,356 | | 10/1992 | Sorenson | 239/550 |
| 6,000,636 | * | 12/1999 | Huang | 239/464 X |

* cited by examiner

*Primary Examiner*—Lesley D. Morris
(74) *Attorney, Agent, or Firm*—Jordan M. Meschkow; Lowell W. Gresham; Meschow & Gresham, P.L.C.

(57) ABSTRACT

A misting head system (24) configured to render a fluid (32) into a mist (36) is provided. The system (24) includes a misting head body (26) and a poppet (20). The misting head body (26) has a cylindrical chamber (28), an inlet (30) configured to pass the fluid (32) into the chamber (28), and an orifice (34) configured to pass the fluid (32) out of the chamber (28) and to render the fluid (32) into the mist (36). The poppet (20) has a cylindrical core (38) configured to force the fluid (32) to pass through a space (44) between the core (38) and an inner wall (46) of the chamber (28), a fracture band (54) coupled to the core (38), configured to center the core (38) within the chamber (28), and having a plurality of flutes (60) configured to fracture the fluid (32) as the fluid (32) passes through the space (44), and an orifice end (40) of the core possessing a plurality of symmetrically spaced slits (48) configured to further fracture the fluid (32).

22 Claims, 2 Drawing Sheets

MISTING HEAD POPPET

RELATED INVENTION

The present invention is a continuation in part (CIP) of "Misting Head poppet," U.S. patent application Ser. No. 29/095,590, filed Oct. 27, 1998, and now U.S. Pat. No. 0,412,557, which is incorporated by reference herein.

TECHNICAL FIELD OF THE INVENTION

The present invention relates to the field of misting systems. More specifically, the present invention relates to misting head poppets.

BACKGROUND OF THE INVENTION

A misting system converts a fluid, typically water, into a mist or fog. One of the primary uses of such a system is to cool the proximate area. Such cooling takes place by evaporation of the mist or fog. The efficiency of evaporation, hence the efficiency of cooling, is a function of droplet size. The smaller the droplet, the more rapid its evaporation and the greater the cooling efficiency. A type of mist more precisely considered to be a fog is preferable to a mist having larger droplets.

A misting system has one or more misting heads, which perform the actual conversion of the fluid into a mist or fog. In order to accomplish this, the misting head fractures the water, i.e., disrupts molecular cohesion. The fluid enters the misting head under pressure. A fluid moving under pressure pulsates. This pulsation is due in part to air entrained within the fluid, and in part to turbulence created by friction and other factors.

The pulsating fluid exits the misting head through an orifice. This orifice serves to fracture the fluid into a fine spray. Usually, this fracturing is insufficient to produce the desired mist or fog, and further fracturing is desirable.

This further fracturing is typically provided by the addition of a poppet to the misting head. The misting head is formed with a cylindrical chamber within which the poppet resides. The pulsation of the fluid causes the poppet to vibrate within the chamber and fracture the fluid. This fractured fluid then exits the misting head through the orifice and undergoes further fracturing. This compound fracturing action improves the quality of atomization compared to systems that do not employ compound fracturing.

A problem occurs in that the poppet may occasionally seat against the orifice in such a manner that the flow is cut off. Should this occur, the fluid pressure may serve to hold the poppet in this position. In conventional misting heads, this problem is solved by cutting one or more small blind slits in the orifice end of the poppet. These slits serve to prevent a perfect seal from forming between the end of the poppet and the orifice. Without such a seal, the fluid vibration serves to prevent the poppet from remaining in this position. Also, these slits cause the poppet to spin. This spin serves to increase the vibration of the poppet. This increased vibration increases the fracturing of the fluid. Additionally, the edges of the slits themselves create an additional turbulence of the fluid. This additional turbulence again increases the fracturing action.

The poppet must be smaller in diameter than the chamber in which it resides. This allows the poppet to spin and vibrate within the chamber and allows fluid to pass by the poppet within the chamber. A problem exists, however, in that the poppet may undergo a certain amount of lateral movement within the chamber. This lateral movement varies the space between the poppet and the chamber wall in a totally random manner. This in turn produces random variations in the pressure present at the orifice, hence the degree of fracture produced by the orifice. This may result in spitting, dribbling, or other undesirable output from the misting head.

Additionally, the poppet may become skewed and wedge within the chamber. This is accompanied by a significant decrease in the amount of fracture and an undesirable degradation of the output from the misting head.

What is desirable, therefore, is a way of keeping a poppet centered within a misting head chamber and controlling lateral poppet movement. This would in turn maintain a controlled pressure at the orifice, a controlled fracture, and a controlled misting head output.

Even with the fracture slits, a problem also remains in that the pressure must be relatively high to produce a smaller droplet fog rather than a larger droplet type of mist. This high pressure is reflected in more robust piping and other components, including the misting heads themselves.

What is desirable, therefore, is a way of increasing the amount of fracture, thus producing a given fog output at a lower pressure. This in turn would allow a decrease in component robustness for a given amount of mist, with a corresponding decrease in system cost and complexity.

SUMMARY OF THE INVENTION

Accordingly, it is an advantage of the present invention that an improved misting head poppet is provided.

It is another advantage of the present invention that a misting head poppet is provided that has a cylindrical adaptation configured to inhibit the lateral movement of the poppet and prevent the poppet from becoming cocked within the misting head chamber.

It is another advantage of the present invention that a misting head poppet is provided that has a cylindrical adaptation configured to center the poppet within the misting-head chamber, thus stabilizing orifice pressure for a more uniform misting action.

It is another advantage of the present invention that a misting head poppet is provided that has a fracture band configured to fracture the fluid, thus adding to the overall fracture of the fluid and producing a finer mist or fog for a given pressure.

The above and other advantages of the present invention are carried out in one form by a poppet for a misting head, wherein the misting head is configured to render a fluid into a mist, has a body, a cylindrical chamber within the body, an inlet into the chamber, and an orifice opposing the inlet. The poppet has a cylindrical core configured to reside within the chamber, wherein a first end of the core is configured to be positioned within the chamber proximate the orifice, and a second end of the core is configured to be positioned within the chamber farther from the orifice than the first end. The poppet has a fracture band coupled to the core and configured to center the core within the chamber.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
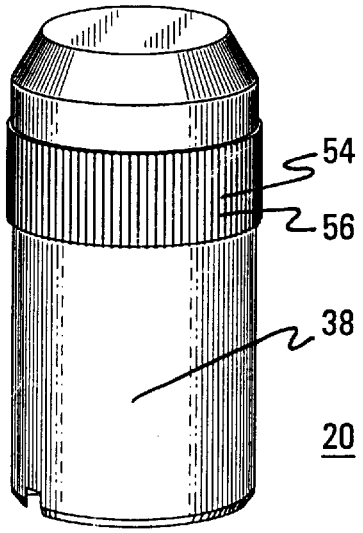
FIG. 1 shows a front perspective view of a misting head poppet in accordance with a preferred embodiment of the present invention.
Figure 2:
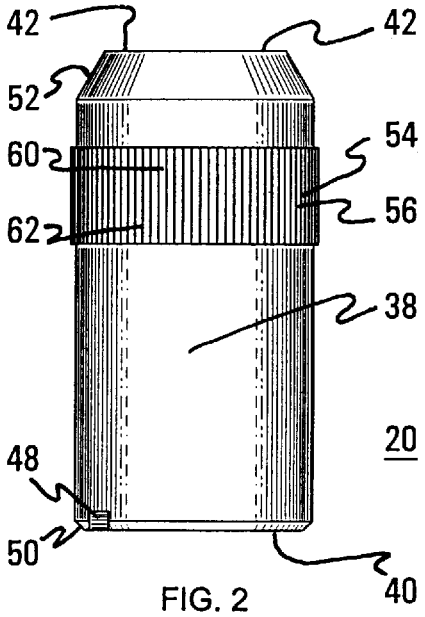
FIG. 2 shows a front view of the misting head poppet of FIG. 1, a rear view being identical thereto, in accordance with a preferred embodiment of the present invention.
Figure 3:
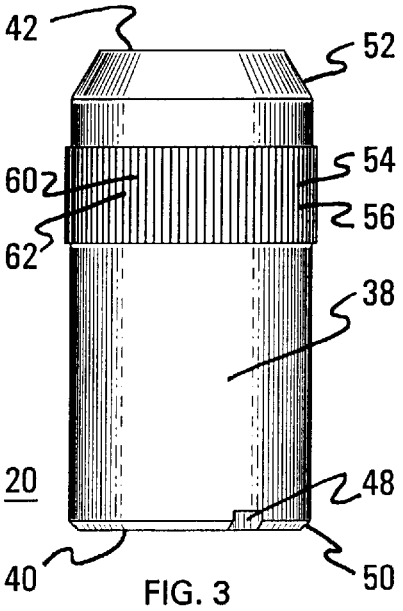
FIG. 3 shows a left side view of the misting head poppet of FIG. 1, a right side view being identical thereto, in accordance with a preferred embodiment of the present invention.
Figure 4:
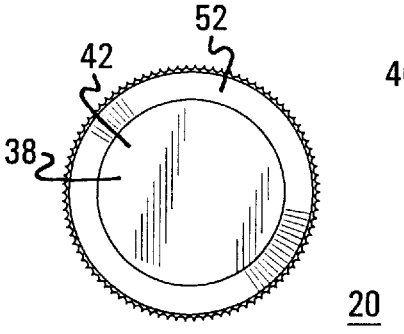
FIG. 4 shows an input end view of the misting head poppet of FIG. 1 in accordance with a preferred embodiment of the present invention.
Figure 5:
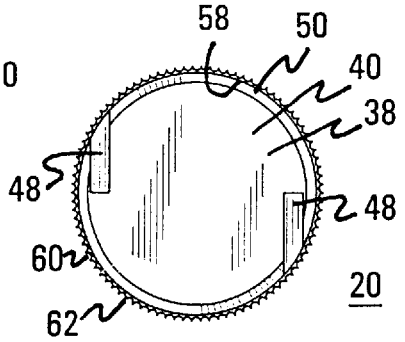
FIG. 5 shows an orifice end view of the misting head poppet of FIG. 1 in accordance with a preferred embodiment of the present invention.
Figure 6:
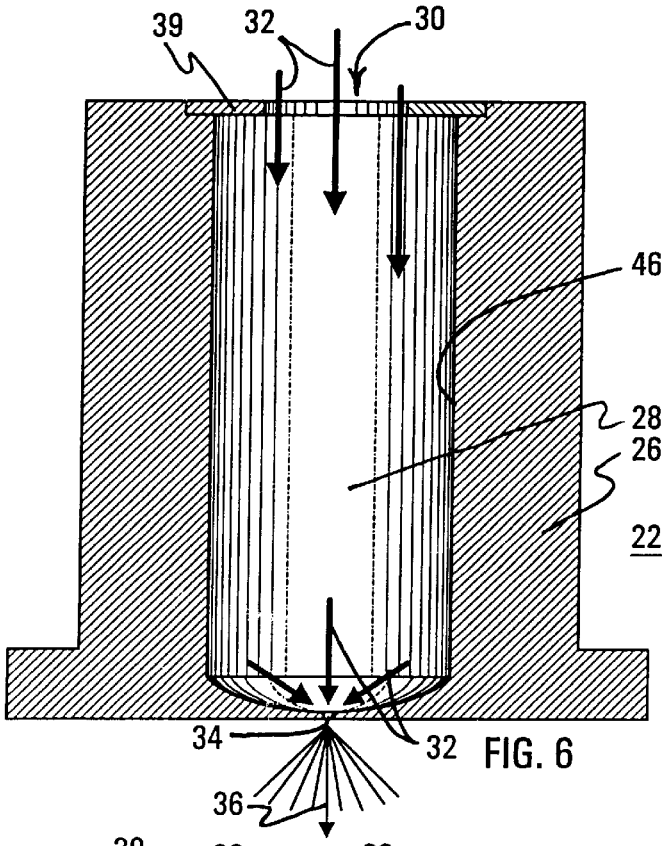
FIG. 6 shows a cutaway front view of a misting head in accordance with a preferred embodiment of the present invention.
Figure 7:
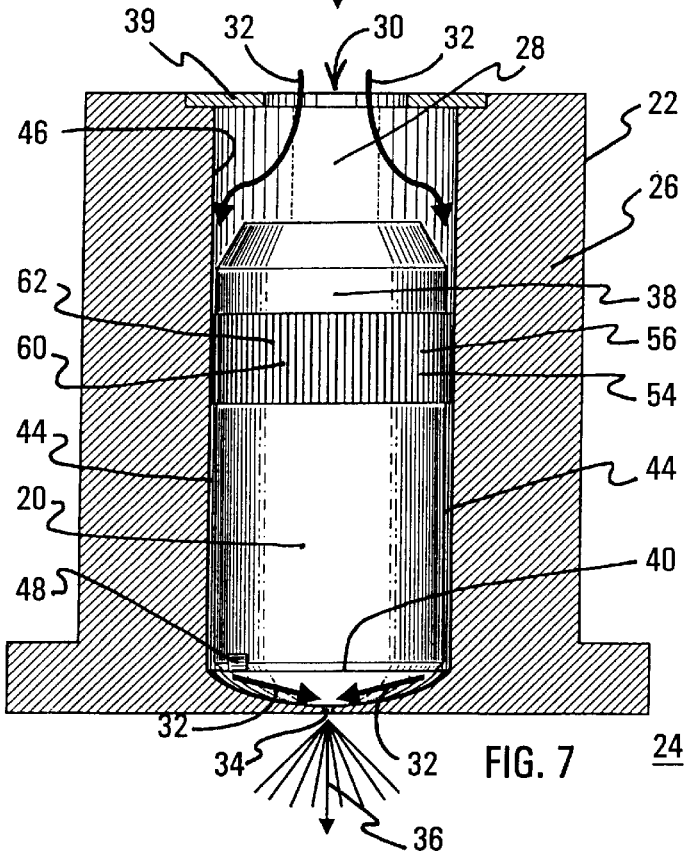
FIG. 7 shows a cutaway front view of the misting head of FIG. 6 with the misting head poppet of FIG. 1 located therein in accordance with a preferred embodiment of the present invention.

FIGS. 1 through 5 show a misting head poppet 20 in accordance with a preferred embodiment of the present invention, with FIG. 1 showing a front perspective view, FIG. 2 showing a front view (a rear view being identical thereto), FIG. 3 showing a left side view (a right side view being identical thereto), FIG. 4 showing an input end view, and FIG. 5 showing an orifice end view, respectively. FIGS. 6 and 7 shows a cutaway front view of a misting head 22 in accordance with a preferred embodiment of the present invention, FIG. 6 without and FIG. 7 with misting head poppet 20 located therein, respectively. The following discussion refers to FIGS. 1 through 7.

Misting head 22 and misting head poppet 20 together make up a misting head system 24. Misting head 22 is made up of a misting head body 26 having a cylindrical chamber 28 with an inlet 30 at one end and an orifice 34 at the other end. A fluid 32, typically water, enters chamber 28 through inlet 30 and exits through orifice 34, where fluid 32 is fractured and rendered into a mist 36 by misting head 22, i.e., by misting head system 24.

Misting head poppet 20 resides within cylindrical chamber 28. Poppet 20 is made up of a cylindrical core 38 configured to reside within cylindrical chamber 28. That is, the length and diameter of core 38 are both less than the length and diameter of chamber 28, respectively.

Poppet 20 is free to reside anywhere within chamber 28. That is, poppet 20 may at some instances be proximate inlet 30 and at other instances be proximate orifice 34. A retaining ring 39 or other device or technique well known to those skilled in the art is used to prevent poppet 20 from leaving chamber 28.

Poppet core 38 has an orifice end 40 and an inlet end 42. In normal operation, pressure within the flow of fluid 32 is sufficient to cause poppet 20 to reside primarily proximate orifice 34. Orifice end 40 is that end of poppet 20 positioned within chamber 28 more proximate orifice 34. Inlet end 42, therefore, is that end of poppet 20 positioned within chamber 28 more proximate inlet 30, i.e., is that end farther from orifice 34 than orifice end 40.

The presence of poppet 20 within chamber 28 forces fluid 32 passing through chamber 28 to pass through a space 44 between core 38 and an inner wall 46 of chamber 28. Poppet 20 is configured to vibrate within chamber 28. Through this vibration, poppet 20 fractures fluid 32 as it passes through space 44. This fractured fluid 32 is then further fractured by orifice 34 and rendered into mist 36.

In the preferred embodiment of FIGS. 1, 2, 3, 5, and 7, orifice end 40 of poppet 20 has a pair of blind fracture slits 48. Slits 48 are cut partway across orifice end 40 along a chord. Being blind and partially chordal, slits 48 react with fluid 32 to cause poppet 20 to spin. The shape of slits 48 and the spinning of poppet 20 act to fracture fluid 32. Since fluid 32 is already fractured by the vibration of poppet 20, it is further fractured by slits 48 and again further fractured by orifice 34. For a given pressure, the greater the fracturing of fluid 32, the finer mist 36 will become. Since ideally mist 36 would be so fine as to be a fog, any increase in fracturing is desirable.

Those skilled in the art will appreciate a particular number of fracture slits 48 is not a requirement of the present invention, and that poppet 20 may have any number of fracture slits 48. When more than one fracture slit 48 is used, the best performance is achieved when these multiple slits 48 are symmetrically placed around the edge of orifice end 40 of core 38. The use of other than a pair of fracture slits 48 is within the spirit of the present invention.

In the preferred embodiment of FIGS. 1, 2, 3, 5, and 7, a chamfer 50 is depicted between poppet core 38 and orifice end 40. Chamfer 50 allows better seating of core 38 against the end of cylindrical chamber 28, thus enhancing the fracture characteristics of poppet 20, and eases the task of inserting poppet 20 into chamber 28 during manufacturing.

Similarly, FIGS. 1, 2, 3, 5, and 7 depict a chamfer 52 between poppet core 38 and inlet end 42. Chamfer 52 serves to guide fluid 32 into space 44 between core 38 and inner wall 46 of chamber 28. Through the use of chamfer 52, lateral motions of poppet 20 are reduced, thus equalizing the pressure of fluid 32 at orifice 34 and improving the fracture effect thereof.

Those skilled in the art, however, will appreciate that the presence of chamfers 50 and/or 52, and the amount and angle of chamfers 50 and/or 52, when present, are not requirements of the present invention.

Between orifice end 40 and inlet end 42 of cylindrical core 38, poppet 20 has a fracture band 54. Fracture band 54 is formed of a cylindrical protrusion (extrusion, projection, or other adaptation) 56 integrally formed onto an outer circumference 58 of cylindrical core 38. Fracture band 54 has an overall diameter greater than that of cylindrical core 38 and less than that of cylindrical chamber 28.

Fracture band 54 serves to improve the fit of poppet 20 into cylindrical chamber 28. Because of this improved fit, fracture band 54 centers cylindrical core 38 within cylindrical chamber 28. This serves to reduce any tendency of poppet 20 to skew within chamber 28 and reduces the likelihood of poppet 20 wedging within chamber 28.

Were fracture band 54 formed solely of cylindrical protrusion 56, fracture band 54 would effectively occlude space 44 between core 38 and inner wall 46 of chamber 28. This condition is avoided by forming fracture band 54 of cylindrical protrusion 56 into which a plurality of parallel flutes 60 have been formed. In the preferred embodiment of FIGS. 4 and 5, flutes 60 are depicted as semicircular grooves formed into protrusion 56. In the preferred embodiment, flutes 60 are formed by etching. That is, a mask resistant to an etchant is imposed upon protrusion 56 and core 38. The etchant is then applied to etch semicylindrical flutes 60 into protrusion 56. Those skilled in the art, however, will appreciate that other methods of producing flutes 60, such as machining, extruding, etc., and other shapes of flutes 60 may be used without departing from the spirit of the present invention.

Adjacent flutes 60 are separated by a ridge 62. The overall diameter of cylindrical protrusion 56 is taken as twice the distance from a central axis of cylindrical core 38 to the outermost edge of any ridge 62. This overall diameter, as previously described, is such as to allow poppet 20 to move freely within cylindrical chamber 28 without skewing.

Fluid 32 passing through space 44 between core 38 and inner wall 46 of chamber 28 is forced to pass through flutes 60. This passage fractures fluid 32. Fluid 32, therefore, is fractured by the vibration of poppet 20 before flutes 60, is further fractured by flutes 60 of fracture band 54, is further fractured by the vibration of poppet 20 after flutes 60, is further fractured by fracture slits 48 and the rotation of poppet 20, and is further fractured by orifice 34. The result of this multi-stage fracturing process is the rendering of fluid 32 into mist 36 as a fine fog.

Figure 8:
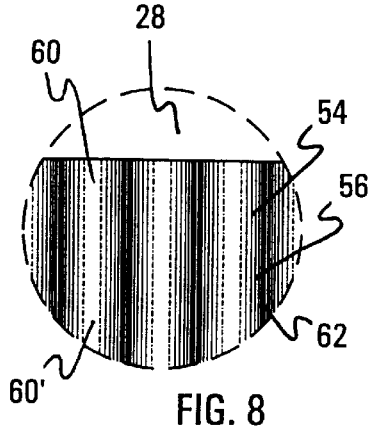
FIG. 8 shows a front view of a portion of an edge of a fracture band with longitudinal flutes in accordance with a first preferred embodiment of the present invention.
Figure 9:
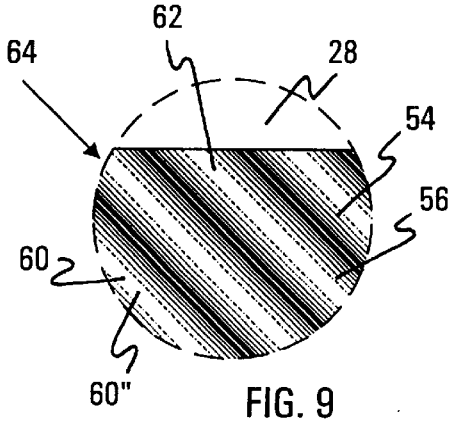
FIG. 9 shows a front view of a portion of an edge of a fracture band with helical flutes in accordance with an alternative preferred embodiment of the present invention.
Figure 10:
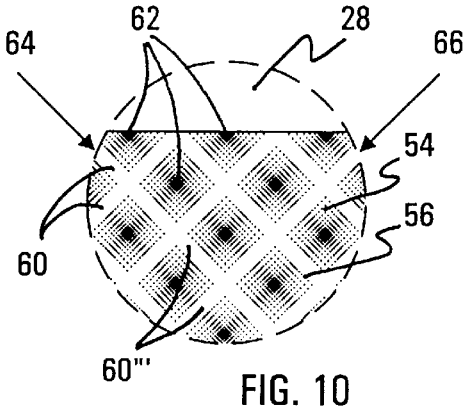
FIG. 10 shows a front view of a portion of an edge of a fracture band with bihelical flutes in accordance with another alternative preferred embodiment of the present invention.

The forming of flutes 60 in protrusion 56 affects the fracturing action of poppet 20. FIGS. 8, 9, and 10 show magnified front views of portions of edges of differing fracture bands 54 and demonstrate variations in the forming of flutes 60 in accordance with preferred embodiments of the present invention. The following discussion refers to FIGS. 7, 8, 9, and 10.

FIG. 8 demonstrates longitudinal flutes 60', i.e., substantially parallel flutes 60 longitudinally formed into fracture band 54. The axes of longitudinal flutes 60' are parallel to a central axis of core 38. Longitudinal flutes 60' fracture fluid 32 without imparting additional motion to core 38.

FIG. 9 demonstrates helical flutes 60", i.e., generally parallel flutes 60 helically formed into fracture band 54. The axes of helical flutes 60" form helices around the circumference of protrusion 56 in a spiral direction 64. Helical flutes 60" fracture fluid 32 while imparting a rotational motion to core 38. Depending upon spiral direction 64, this rotational motion may augment or detract from the rotational motion imparted by fracture slits 48. The use of helical flutes 60", therefore, is a means for controlling the overall fracture characteristics of poppet 20.

FIG. 10 demonstrates bihelical flutes 60'", i.e., two sets of generally parallel flutes 60 independently formed into fracture band 54. The axes of one set of flutes 60 form helices around the circumference of protrusion 56 in a first spiral direction 64, while the axes of the other set form helices in a second spiral direction 66 opposing first spiral direction 64. That is, flutes 60 spiraling in second spiral direction 66 spiral around cylindrical protrusion 56 in an opposite spiral direction from flutes 60 spiraling in first spiral direction 64. Bihelical flutes 60'" fracture fluid 32 without imparting additional rotational motion to core 38, but while imparting increased vibrational motion to core 38 over longitudinal flutes.

Those skilled in the art will appreciate that the present invention requires no specific form for flutes 60, other than a form which communicates fluid 32 through space 44, and that the use of longitudinal flutes 60', helical flutes 60", bihelical flutes 60'", and other forms of flutes 60 is within the spirit of the present invention.

In summary, the present invention teaches an improved misting head poppet 20. Within poppet 20, cylindrical protrusion 56 is configured to inhibit the lateral movement of poppet 20 and prevent poppet 20 from becoming cocked within misting head chamber 28. Within poppet 20, cylindrical protrusion 56 is also configured to center poppet 20 within misting-head chamber 28, thus stabilizing the pressure of fluid 32 at orifice 34 to produce a more uniform mist 36. Poppet 20 also has a plurality of flutes 60 formed on cylindrical protrusion 56 to produce fracture band 54 and fracture fluid 32, thus adding to the overall fracture of fluid 32 and rendering fluid 32 into a finer mist 36 than would otherwise be possible for a given pressure.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A poppet for a misting head, wherein said misting head has a cylindrical chamber with an inlet at a first end thereof and an orifice at a second end thereof substantially in opposition to said first end, and wherein said misting head is configured to render a fluid into a mist after a movement of said fluid from said inlet through said orifice, said poppet comprising:

a cylindrical core configured to reside anywhere within said chamber, and configured to move within said chamber in response to said fluid movement;

a first end of said core, wherein said first end is configured to be positioned within said chamber proximate said orifice in response to said fluid movement;

a second end of said core said band comprising a cylindrical protrusion having a length less than the length of said cylindrical core, wherein said second end is configured to be positioned within said chamber farther from said orifice than said first end; and a fracture band coupled to said core and configured to center said core within said chamber.

2. A misting head poppet as claimed in claim 1 wherein said fracture band is integrally formed on an outer circumference of said core.

3. A misting head poppet as claimed in claim 1 wherein said fracture band comprises a plurality of flutes separated by ridges.

4. A misting head poppet as claimed in claim 3 wherein said flutes are longitudinally formed into said fracture band.

5. A misting head poppet as claimed in claim 3 wherein said flutes are helically formed into said fracture band.

6. A misting head poppet as claimed in claim 3 wherein said flutes are bihelically formed into said fracture band.

7. A misting head poppet as claimed in claim 1 additionally comprising a fracture slit in said first end of said cylindrical core.

8. A misting head poppet as claimed in claim 7 wherein said fracture slit is one of a plurality of fracture slits symmetrically arranged in said first end of said cylindrical core.

9. A misting head poppet as claimed in claim 1 additionally comprising a chamfer between said cylindrical core and said first end thereof.

10. A misting head poppet as claimed in claim 1 wherein:

said inlet is configured to pass said fluid into said cylindrical chamber;

said second end of said cylindrical core is configured to force said fluid into a space between said cylindrical core and an inner wall of said cylindrical chamber;

said fracture band is configured to fracture said fluid while centering said cylindrical core within said cylindrical chamber;

said first end of said cylindrical core is configured to further fracture said fluid and is configured to pass said fluid to said orifice; and said orifice is configured to pass said fluid out of said cylindrical chamber and to render said fluid into said mist.

11. A misting head system configured to render a fluid into a mist as a result of a movement of said fluid, said system comprising:

a misting head body comprising a cylindrical chamber; and a poppet configured to reside within said chamber, configured to move within said chamber in response to said fluid movement, and comprising a cylindrical core wherein said core has a cylindrical protrusion forming a fracture band having a length less than a length of said cylindrical core and configured to center said cylindrical core within said cylindrical chamber.

12. A misting head system as claimed in claim 11 wherein:

said poppet is configured to force said fluid to pass through a space between said cylindrical core and an inner wall of said cylindrical chamber in response to said fluid movement; and said fracture band is configured to fracture said fluid as said fluid passes through said space.

13. A misting head system as claimed in claim 12 wherein said poppet is configured to vibrate as said fluid passes through said space in response to said fluid movement.

14. A misting head system as claimed in claim 11 wherein:

said misting head body additionally comprises an orifice configured to pass said fluid out of said cylindrical chamber in response to said fluid movement;

said poppet additionally comprises an orifice end of said cylindrical core, wherein said orifice end is configured to be positioned within said cylindrical chamber proximate said orifice; and said poppet additionally comprises a fracture slit in said orifice end.

15. A misting head system as claimed in claim 14 wherein:

said fracture band is configured to fracture said fluid;

said fracture slit is configured to further fracture said fluid;

said orifice is configured to further fracture said fluid; and said fracturing of said fluid by said fracture band, said fracture slit, and said orifice renders said fluid into said mist.

16. A misting head system as claimed in claim 14 wherein said poppet is configued to rotate as said fluid passes through and over said fracture slit in response to said fluid movement.

17. A misting head system as claimed in claim 11 wherein said fracture band comprises a plurality of flutes formed into said cylindrical protrusion.

18. A misting head system as claimed in claim 17 wherein said plurality of flutes is longitudinally formed into said cylindrical protrusion.

19. A misting head system as claimed in claim 17 wherein said plurality of flutes is helically formed into said cylindrical protrusion.

20. A misting head system as claimed in claim 19 wherein;

said plurality of flutes is a first plurality of flutes:

said first plurality of flutes is helically formed into said cylindrical protrusion in a first spiral direction; and a second plurality of flutes is helically formed into said cylindrical protrusion in a second spiral direction opposing said first spiral direction.

21. A misting head system as claimed in claim 17 wherein said plurality of flutes is formed into said cylindrical protrusion by etching.

22. A misting head system configured to render a fluid into a mist as a result of a movement of said fluid, said system comprising:

a misting head body comprising:

a cylindrical chamber;

an inlet configured to pass said fluid into said cylindrical chamber during said fluid movement; and an orifice configured to pass said fluid out of said cylindrical chamber during said fluid movement, and to render said fluid into said mist; and a poppet configured to reside anywhere within said cylindrical chamber, and configured to move within said cylindrical chamber as a result of said fluid movement, said poppet comprising:

a cylindrical core configured to force said fluid to pass through a space between said cylindrical core and an inner wall of said cylindrical chamber;

a cylindrical protrusion integrally formed onto an outer diameter of said cylindrical core and having a length less than a length of said cylindrical core;

a fracture band formed of said cylindrical protrusion, configured to center said cylindrical core within said cylindrical chamber, and having a plurality of flutes configured to fracture said fluid as said fluid passes through said space; and an end of said cylindrical core possessing a plurality of fracture slits symmetrically positioned in said end, wherein said end is configured to be positioned within said cylindrical chamber proximate said orifice and said fracture slits are configured to fracture said fluid.

* * * * *